US006173265B1

(12) United States Patent
Takahashi

(10) Patent No.: US 6,173,265 B1
(45) **Date of Patent: *Jan. 9, 2001**

(54) VOICE RECORDING AND/OR REPRODUCING METHOD AND APPARATUS FOR REDUCING A DETERIORATION OF A VOICE SIGNAL DUE TO A CHANGE OVER FROM ONE CODING DEVICE TO ANOTHER CODING DEVICE

(75) Inventor: Hidetaka Takahashi, Musashino (JP)

(73) Assignee: Olympus Optical Co., Ltd., Tokyo (JP)

( * ) Notice: Under 35 U.S.C. 154(b), the term of this patent shall be extended for 0 days.

This patent is subject to a terminal disclaimer.

(21) Appl. No.: 08/772,394

(22) Filed: Dec. 23, 1996

(30) Foreign Application Priority Data

Dec. 28, 1995 (JP) ..... 7-352142

(51) Int. Cl.[7] ..... G10L 5/02

(52) U.S. Cl. ..... 704/262; 704/201; 704/270; 704/214; 704/215

(58) Field of Search ..... 704/262, 258, 704/201, 214, 219, 220, 208, 229, 270

(56) References Cited

U.S. PATENT DOCUMENTS

| | | | | |
|---|---|---|---|---|
| 4,330,689 | * | 5/1982 | Kang et al. | 370/84 |
| 4,771,465 | * | 9/1988 | Bronson et al. | 704/207 |
| 4,890,327 | * | 12/1989 | Bertrand et al. | 381/38 |
| 4,899,385 | | 2/1990 | Ketchum et al. | 381/36 |
| 5,119,092 | * | 6/1992 | Sumi et al. | 341/60 |
| 5,272,691 | * | 12/1993 | Watanabe | 369/59 |
| 5,418,658 | * | 5/1995 | Kwon | 360/48 |
| 5,630,010 | * | 5/1997 | Sugiayam et al. | 395/2.1 |
| 5,642,463 | * | 6/1997 | Nakano et al. | 381/3 |
| 5,668,924 | * | 9/1997 | Takahashi | 704/219 |
| 5,742,734 | * | 4/1998 | DeJaco et al. | 395/2.35 |
| 5,754,427 | * | 5/1998 | Akagiri | 704/229 |
| 5,754,554 | * | 5/1998 | Nakahara | 395/2 |
| 5,761,642 | * | 6/1998 | Suzuki et al. | 704/229 |
| 5,787,387 | * | 7/1998 | Aguilar | 704/208 |
| 5,809,468 | * | 9/1998 | Takahashi et al. | 704/278 |

FOREIGN PATENT DOCUMENTS 2-94200A 4/1990 (JP) .

OTHER PUBLICATIONS

Websters II New Riverside University Dictionary, 1994.*
Kroon, Peter. A High Quality Multirate Real–Time CELP Coder. IEEE Journal on Selected Areas in Communications. 850–857, Jun. 1992.*

* cited by examiner

*Primary Examiner*—Emanuel Todd Voeltz
*Assistant Examiner*—M. David Sofocleous
(74) *Attorney, Agent, or Firm*—Kenyon & Kenyon

(57) ABSTRACT

A voice recording and/or reproducing device includes a plurality of coders having different bit rates for coding voice to provide coded voice data, a voice recording mode change over switch for selecting one of the plurality of coders, and a system controller. The system controller stores coding selection data obtained by the change over of the voice recording mode and coded voice data obtained from the selected coder, to a storing medium, and reduces a deterioration of the voice due to the change over. The voice recording and/or reproducing device also includes a detector for detecting the coding selection data, and a plurality of decoders for decoding the coded voice data at the bit rate corresponding to the detected coding selection data.

17 Claims, 8 Drawing Sheets

VOICE RECORDING AND/OR REPRODUCING METHOD AND APPARATUS FOR REDUCING A DETERIORATION OF A VOICE SIGNAL DUE TO A CHANGE OVER FROM ONE CODING DEVICE TO ANOTHER CODING DEVICE

BACKGROUND OF THE INVENTION

1. Field of the Invention

The present invention relates to a voice recording and/or reproducing device.

2. Description of the Related Art

Recently, a device, which is a so-called digital voice recording and/or reproducing device (hereinafter called simply "digital voice recorder"), for recording and/or reproducing a voice has been developed.

The digital recorder collects a voice as an analog signal by a microphone or the like. The analog signal representing the collected voice is converted to a digital signal which is then stored in a storage medium (for example, an IC memory) of the digital recorder. When the recorded voice is reproduced, the stored digital voice is read out from the storage medium and converted to an analog signal. The analog signal is then reproduced by a speaker or the like.

When the digital signal is stored in the storage medium, the digital recorder generally applies a coding technique to compress the volume of data efficiently for saving the space of the storage medium.

The lower the bit rate for coding becomes, the more the volume of the stored digital signal is compressed so that the voice can be recorded for a long time. However, when the bit rate for coding becomes lower, the quality of the reproduced voice deteriorates in proportion to the decline of the bit rate.

Reversely, when the bit rate for coding becomes higher, the quality of the reproduced voice improves in proportion to the increase of the bit rate. However, the data compression rate declines so that the voice cannot be recorded for a long time.

Japanese Laid-Open Patent Application Publication No. Hei 2-94200 discloses a method for recording a voice that switches, if necessary, a coding means between a high quality recording mode for reproducing the recorded voice in high quality and a long time recording mode for recording the voice for a long time.

However, if the recording modes are changed over during the voice recording, the device will reproduce at the change over point a reproduced voice that sounds substantially differently than the input voice and that may be uneasy to listen.

SUMMARY OF THE INVENTION

It is an object of the present invention to provide a digital voice recorder for reproducing a voice in high quality at a change over point where a plurality of coding means are changed over from each other during a voice recording.

In order to achieve the object, a digital voice recorder of the present invention comprises a plurality of voice coding means having different bit rates for coding a voice by providing coded voice data. A selecting means disposed in the digital voice recorder of the present invention selects one of the plurality of voice coding means and provides a coding selection data. Coupled to the selecting means is a recording means for recording the coding selection data and the coded voice data in a storage medium. An IC memory. When the selecting means changes over the coding from one voice coding means to another voice coding means, a deterioration reducing means performs a predetermined process for reducing a deterioration of the voice due to the change over of the coding.

A digital voice recorder according to another aspect of the present invention comprises a plurality of voice decoding means having different bit rates for decoding voice data coded by using a predetermined process for reducing a deterioration of voice due to a change over of coding bit rates. In this embodiment a detecting means detects the coding selection data relating to the coding bit rate at which the voice was recorded, and a reproduction mode for automatically selecting one of the plurality of voice decoding means the voice decoding means which is associated with the bit rate corresponding to the coding selection data detected by the detecting means.

Other and further objects, features and advantages of the invention will appear more fully from the following description.

DETAILED DESCRIPTION

With reference to the accompanying drawings, a first embodiment of the present invention will now be described in detail.

Figure 1:
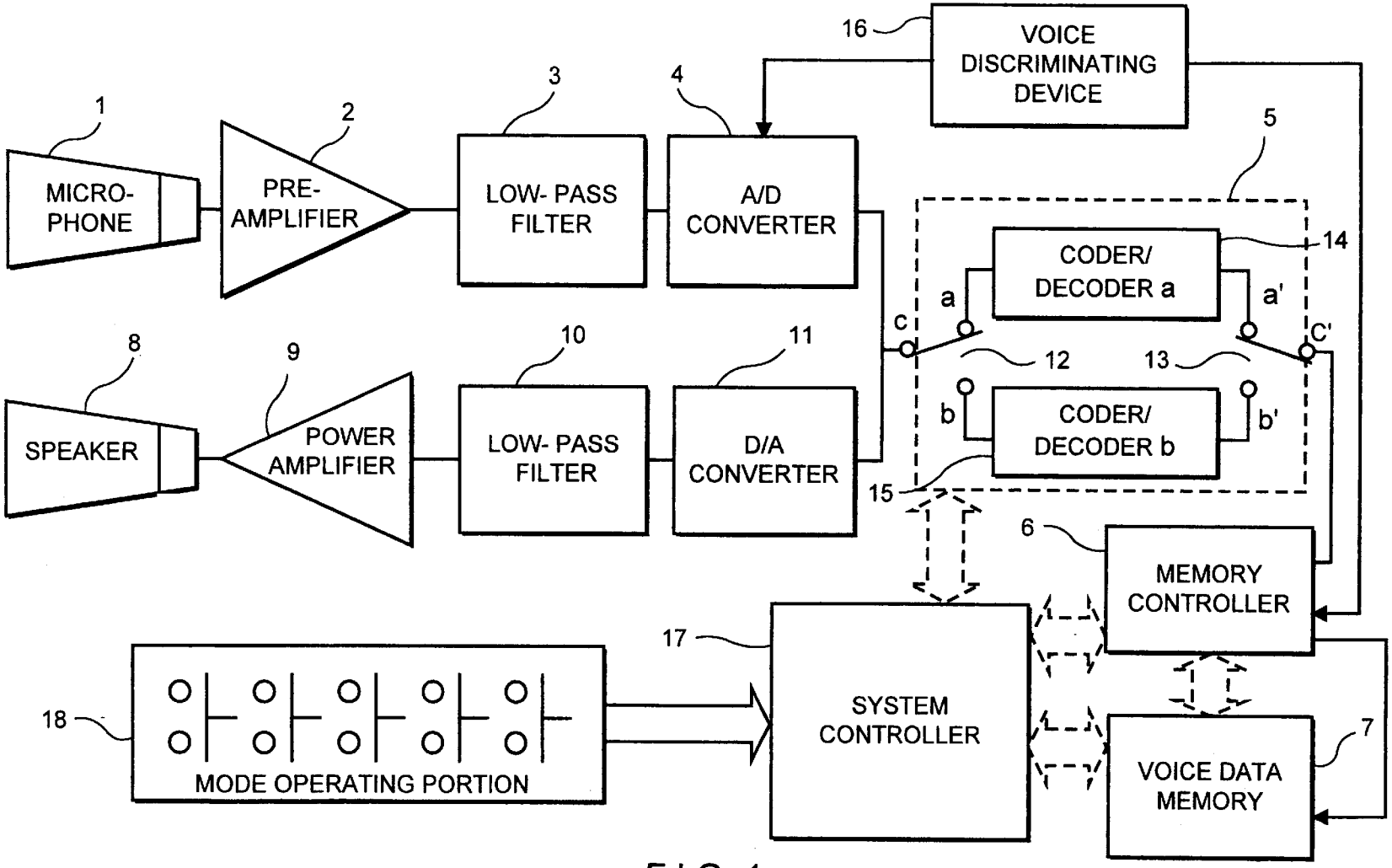
FIG. 1 is a block diagram which shows a structure of a digital voice recorder in a first embodiment of the present invention.

FIG. 1 is a block diagram which shows a structure of a digital voice recorder according to a first embodiment of the present invention.

In FIG. 1, a microphone 1 is coupled to a first switch 12 of a coding/decoding portion 5 through a pre-amplifier 2, a low-pass filter 3 and an analog-to-digital (hereinafter called simply "A/D") converter 4. The first switch 12 functions to switch a flow of digital signals between a terminal a and a terminal b through a terminal c. A second switch 13 of the coding/decoding portion 5 is coupled to a voice data memory 7 through a memory controller 6. The second switch 13 functions to switch a digital signal flow between a terminal a' and a terminal b' through a terminal c'. The voice data memory 7 may be contained in the digital voice recorder or detachably mounted thereon.

A speaker 8 is coupled to the first switch 12 of the first terminal of the coding/decoding portion 5 through a power-amplifier 9, a low-pass filter 10 and a digital-to-analog (hereinafter called simply "D/A") converter 11.

A voice discriminating device 16 is coupled between the A/D converter 4 and the memory controller 6. The voice discriminating device 16 is a means for discriminating whether an input signal is a voice signal or not.

The coding/decoding portion 5 comprises the first switch 12, the second switch 13, a coder/decoder a 14 and a coder/decoder b 15. Both the coder/decoder a 14 and the coder/decoder b 15 are voice coding means having different bit rates.

The terminal c of the first switch 12 is coupled to the A/D converter 4 and the D/A converter 11. The terminal a is coupled to a first terminal of the coder/decoder a 14, and the terminal b is coupled to a first terminal of the coder/decoder b 15. The terminal c' of the second switch 13 is coupled to the memory controller 6. The terminal a' is coupled to a second terminal of the coder/decoder a 14, and the terminal b' is coupled to a second terminal of the coder/decoder b 15.

A system controller 17 is coupled to the coding/decoding portion 5, the memory controller 6, a mode operating portion 18 and the voice data memory 7. The system controller 17 is an element of both a recording means and a controlling means, and controls each of these coupled portions.

The mode operating portion 18 comprises a plurality of operation buttons for selecting respective operation modes, such as a recording mode, a reproducing mode, a stopping mode or the like, to operate the digital voice recorder. The mode operation portion 18 also comprises a recording mode switching button for switching between a high quality recording mode and a long time recording mode if necessary. The high quality recording mode is to improve the quality of a reproduced voice by increasing the bit rate for coding. The long time recording mode is to record a voice for a long time by decreasing the bit rate for coding. When each of these buttons is operated, a signal is generated and transmitted to the system controller 17.

A recording operation of the digital voice recorder is described below.

When a recording button is operated, voice recording will be started. After operating the recording button, a voice collected by the microphone 1 is converted to an analog electrical signal. Then, the analog signal is amplified by the pre-amplifier 2. When the analog signal passes through the low-pass filter 3, the high frequency components of the analog signal are filtered by the low-pass filter 3. The analog signal which is output from the low-pass filter 3 is converted to a digital signal by the A/D converter 4. The voice discriminating device 16 discriminates whether the digital signal represents a voice or not, evaluating whether the intensity of the digital signal which is divided in predetermined time ranges (for example, 20 ms) is over a predetermined threshold level or not. The information of voice discrimination by the voice discriminating device 16 (hereinafter simply called "voice discrimination data") is stored in the voice data memory 7 through the memory controller 6.

After the high quality recording mode or the long time recording mode is selected during the voice recording, the system controller 17 selects and enables either the coder/decoder a 14 or the coder/decoder b 15 in accordance with the selected mode. The selected coder/decoder of the coding/decoding portion 5 codes the digital signal from the A/D converter 4 and outputs a coded digital signal (hereinafter called simply "coded data"). The coded data output from the coding/decoding portion 5 is stored in the voice data memory 7 through the memory controller 6. When the recording mode is switched, the information of recording mode selection (hereinafter called simply "the recording mode selection data") is stored in the voice data memory 7 through the memory controller 6.

A reproducing operation of the digital voice recorder is described below.

When the voice is reproduced, the coded data, the recording mode selection data and the voice discrimination data are read out from the voice data memory 7, and transmitted to the coding/decoding portion 5 through the memory controller 6. In accordance with the received recording mode selection data, the system controller 17 selects and enables either the coder/decoder a 14 or the coder/decoder b 15. The selected coder/decoder decodes the received coded data and outputs a decoded data. The output decoded data is converted to an analog signal by the D/A converter 11. When the analog signal passes through the low-pass filter 10, the high frequency components of the analog signal are filtered by the low-pass filter 10. The output analog signal from the low-pass filter 10 is amplified by the power amplifier 9. The amplified analog signal is reproduced as a voice and output by the speaker 8.

In the above described operations of the voice recording and the voice reproducing modes, the memory controller 6 controls the input/output signals between the voice data memory 7 and the coding/decoding portion 5.

Figure 2:
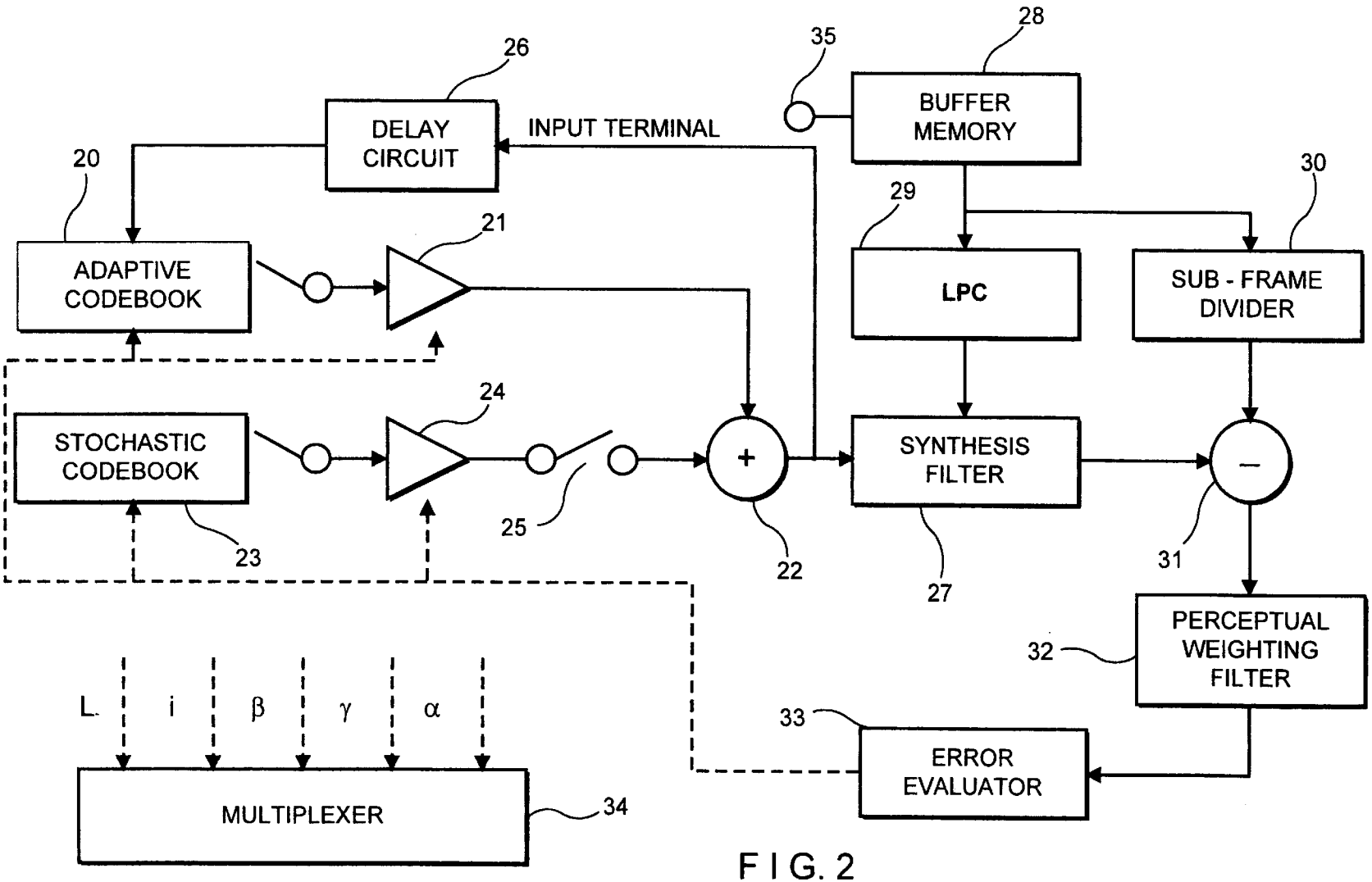
FIG. 2 is a block diagram which shows a detailed structure of a coder in a coding/decoding portion which is schematically illustrated in FIG. 1.

FIG. 2 is a block diagram which shows a structure of a coder in the coder/decoder a 14 which is schematically illustrated in FIG. 1. The coder is a code excited linear predictive (hereinafter called simply "CELP") coder having an adaptive codebook.

In FIG. 2, an adaptive codebook 20 is coupled to a first input terminal of an adder 22 through a multiplier 21. A stochastic codebook 23 is coupled to a second input terminal of the adder 22 through a multiplier 24 and a switch 25. The gain of both the multiplier 21 and the multiplier 24 can be set to a desired value. An output terminal of the adder 22 is coupled to the adaptive codebook 20 through a delay circuit 26 and to a first terminal of a synthesis filter 27.

A buffer memory 28 is coupled to a second input terminal of the synthesis filter 27 through a linear predictor 29. The buffer memory 28 has an input terminal 35 to which the digital signal from the A/D converter 4 is input. The buffer memory 28 is also coupled to a first terminal of a subtracter 31 through a sub-frame divider 30. A second input terminal of the subtracter 31 is coupled to an output terminal of the synthesis filter 27. An output terminal of the subtracter 31 is coupled to an error evaluator 33 through a perceptual weighting filter 32. The error evaluator 33 is coupled to the adaptive codebook 20, the stochastic codebook 23 and the multipliers 21 and 24. The linear predictor 29 and the error evaluator 33 are coupled to a multiplexer 34.

The digital signal is sampled (for example, at 8 kHz), inputted from the input terminal 35 to the buffer memory 28, and stored at predetermined frame intervals (analyzing intervals).

The sampled digital signal stored in the buffer memory 28 is transmitted to the LPC analyzer 29 and the sub-frame divider 30 frame-by-frame.

The linear predictor 29 performs a linear predictive coding on the sampled digital signal, defines a set of linear predictive coding coefficients {$\alpha_i$: i=l, . . . ,p; where i and p are integers}, and transmits the defined coefficients to the synthesis filter 27 and the multiplexer 34.

The sub-frame divider 30 divides the frame into n sub-frames (short analyzing intervals), and forms n sub-frame signals. For example, the digital signal in a frame whose interval is 20 ms and which includes 160 samples is divided by the sub-frame divider 30 into four sub-frames of signals whose interval is 5 ms and each of which includes 40 samples.

A process for defining a delay L and a gain β which are quantized data transmitted from the adaptive codebook 20 to the multiplexer 34 will now be described below. The quantized data correspond to liner predictive residuals.

The delay circuit 26 provides a predetermined delay signal from the adder 22. For example, if the delay circuit provides 40–167 samples as the predetermined delay, 128 kinds of signals are created as the adaptive code vectors and stored in the adaptive codebook 20.

When the switch 25 is open, each adaptive code vector is read out from the adaptive codebook 20, multiplied by a proper gain at the multiplier 21, and input to the synthesis filter 27 through the adder 22. Using the linear predictive coding coefficients and the adaptive code vector, the synthesis filter 27 synthesizes a predictive voice, and transmits a synthesized vector to the subtracter 31.

The subtracter 31 implements subtraction between the vector-quantized from the synthesis filter 27 signal from the sub-frame divider 30 and the synthesized vector and transmits the error vector to the perceptual weighting filter 32. The perceptual weighting filter 32 implements a perceptual weighting process to the error vector, and transmits the result error vector to the error evaluator 33.

The error evaluator 33 calculates the least square mean value of the error vector, and searches the adaptive code vector having the value nearest to the least square mean value from the adaptive codebook 20 to determine the delay L and the gain β. Then the delay L and the gain β are transmitted to the multiplexer 34.

A process for defining an index i and a gain γ which are quantized data transmitted from the stochastic codebook 23 to the multiplexer 34 is described below. The quantized data correspond to linear predictive residuals.

Various vector-quantized stochastic signals are prepared in the stochastic codebook 23. For example, 512 types of stochastic code vectors are prepared for the sub-frame having 40 samples.

Each of the most proper code vectors determined by the above process is read from the adaptive codebook 20, multiplied by the proper gain at the multiplier 21, and transmitted to the adder 22. When the switch 25 is closed, each stochastic code-vector read from the stochastic codebook 23 is multiplied by a proper gain, and transmitted to the adder 22 through the switch 25. The adder 22 adds the stochastic code-vector to the adaptive code-vector, and transmits the added result to the synthesis filter 27. Using the linear predictive coding coefficients and the stochastic code-vector, the synthesis filter 27 synthesizes a predictive voice, and transmits a synthesized vector to the subtracter 31.

The subtracter 31 implements subtraction between the vector-quantized signal from the sub-frame divider 30 and the synthesized vector and transmits the resultant error vector to the perceptual weighting filter 32. The perceptual weighting filter 32 implements a perceptual weighting process to the error vector, and transmits it to the error evaluator 33.

The error evaluator 33 minimizes the error power, searches the stochastic code-vector for which the error power is minimized and transmits its index i and the gain γ to the multiplexer 34.

The multiplexer 34 multiplexes the quantized linear predictive coefficients, the delay L and the gain β from the adaptive codebook 20, the index i and the gain γ from the stochastic codebook 23, and the voice discrimination data from the voice discriminating device 16 as shown in FIG. 1. The result is to be transmitted to the voice memory 7 through the memory controller 6.

If the coder/decoder a 14 codes at 8 Kbit/s, the coder/decoder b 15 codes at 4 Kbit/s. The design of the coder/decoder b 15 is the same as that of FIG. 2, the frame of signals processed in the coder/decoder b 15 is twice as much as the frame of signals processed in the coder/decoder a 14, and the number of dimensions of the stochastic codebook 23 is also doubled. It is not always necessary that the coder/decoder a 14 and the coder/decoder b 15 have the same structure for coding. However, if they have the same structure as stated above, they can be smaller since internal circuits can be used commonly.

Figure 3:
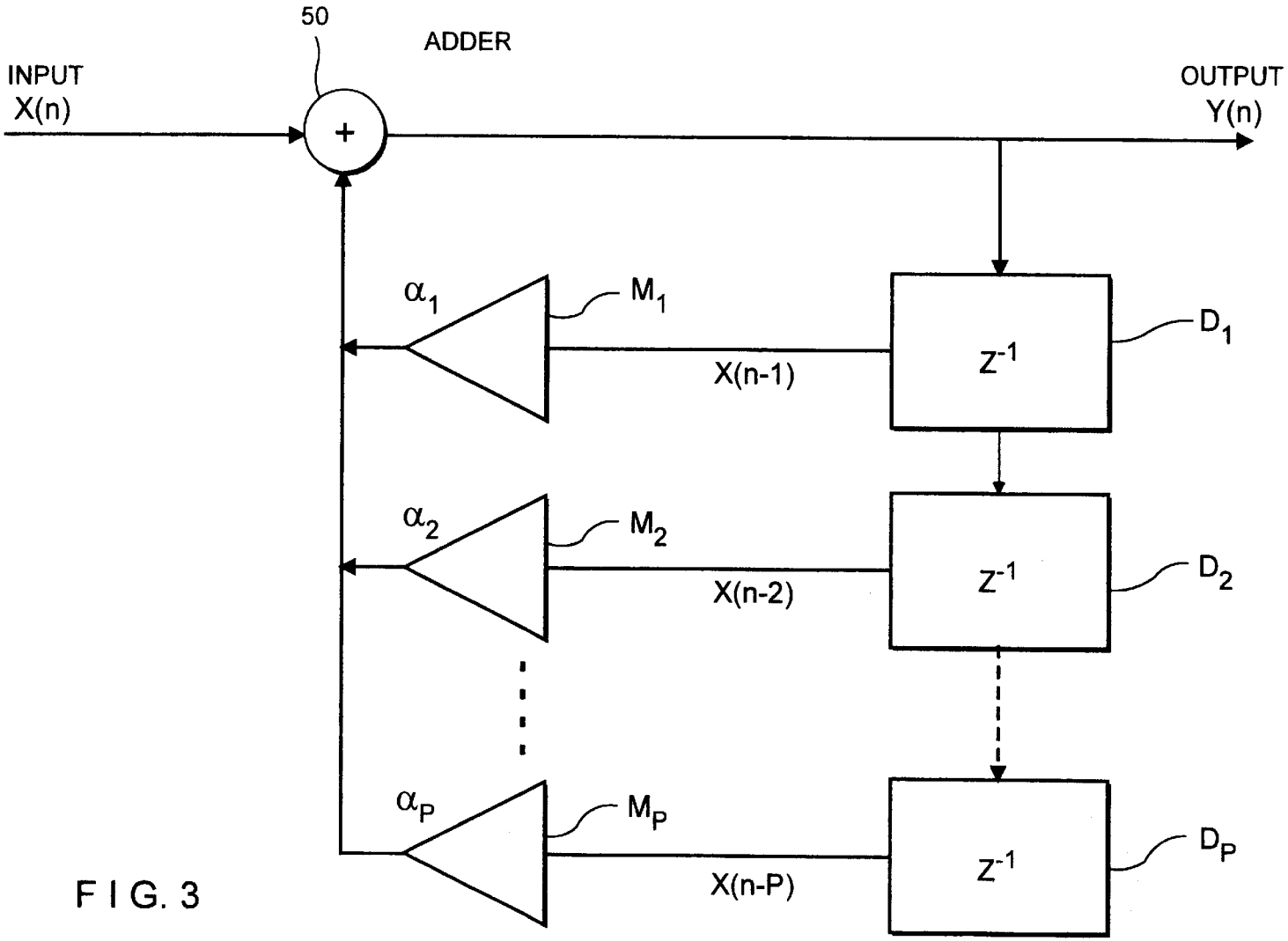
FIG. 3 is a diagram which shows an example of structure of a synthesis filter in the first embodiment of the present invention.

FIG. 3 is a diagram which shows an example of the structure of the synthesis filter 27.

In FIG. 3, the synthesis filter 27 comprises an adder 50, a set of multipliers {$M_i$: i=l, . . . ,p ; where i and p are integers}, and a set of delay circuits {Di: i=l, . . . ,p ; where i and p are integers}.

X(n) is an input signal, and Y(n) is an output signal where n is an integer which satisfies the following condition (1).

$$0 \leq n < N-1$$

where N is the sample from the sub-frame. (1)

X(n−1) is next-to-the last input signal; X(n−2) is the input signal immediately before X(n−1); and X(n−p) is the (n−p) the input signal. The past input signals are stored in a shift register or the like. Such a stored condition of the past input signals is called an initialized condition or an internal condition of the synthesis filter 27.

Based on the past input signals and the linear predictive coefficients, the output signal Y(n) is obtained as a form of an equation (2):

$$Y(n)=X(n)+\alpha_1 X(n-1)+\alpha_2 X(n-2)+\ldots+\alpha_p X(n-p) \quad (2)$$

Figure 4:
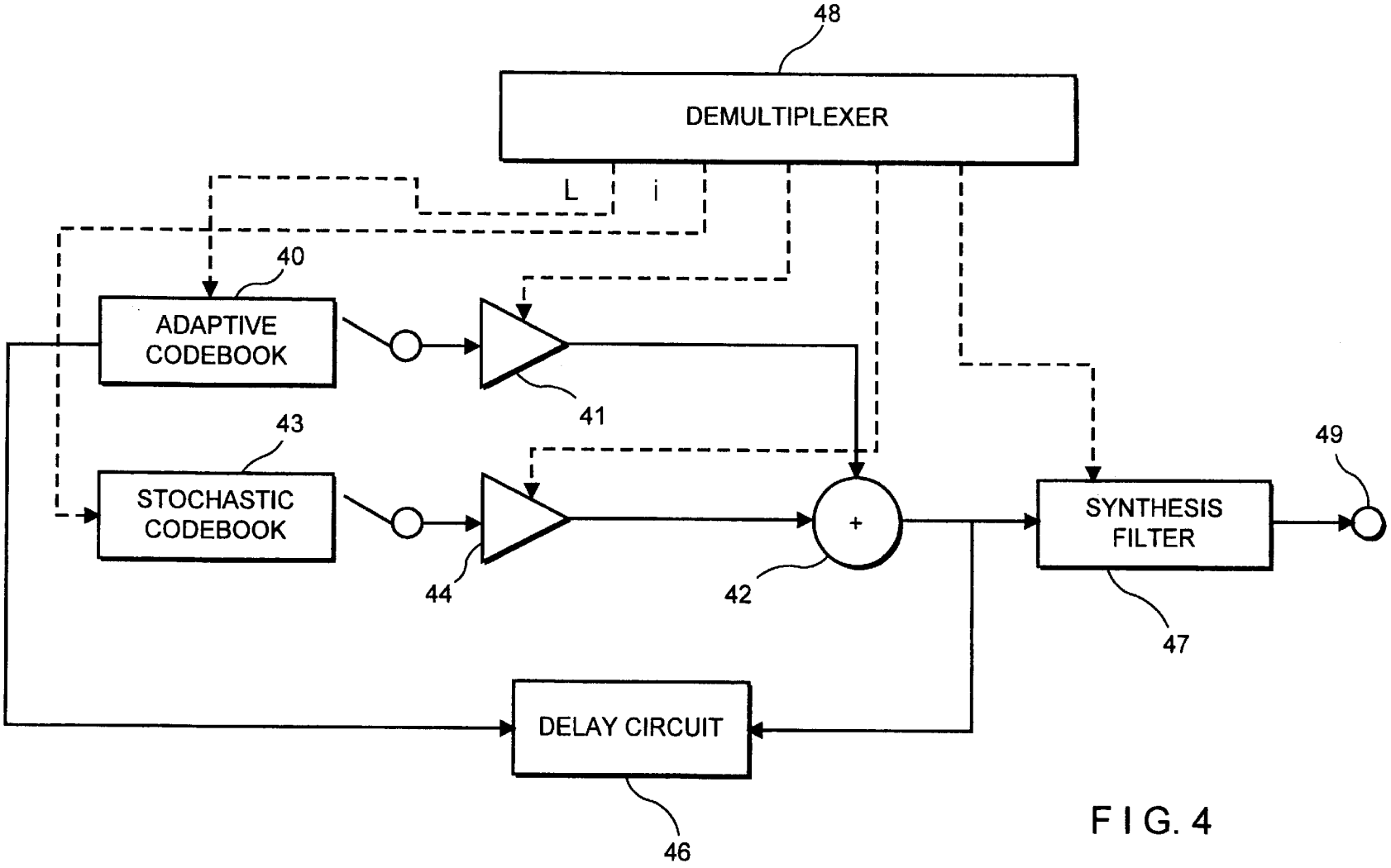
FIG. 4 is a block diagram which shows a detailed structure of a decoder in the coding/decoding portion which is schematically illustrated in FIG. 1.

FIG. 4 is block diagram which shows a detailed structure of a decoder in the coding/decoding portion 5 which is schematically illustrated in FIG. 1. The decoder operates corresponding to the coder as shown in FIG. 2.

In FIG. 4, an adaptive codebook 40 is coupled to a first input terminal of an adder 42 through a multiplier 41. A stochastic codebook 43 is coupled to a second input terminal of the adder 42 through the multiplier 44. An output terminal of the adder 42 is coupled to the adaptive codebook 40 through a delay circuit 46, and the adder 42 is also coupled to a first input terminal of the synthesis filter 47 having an output terminal 49. The structure of the synthesis filter 47 is the same as the synthesis filter 27 in FIG. 2.

A demultiplexer 48 is coupled to the adaptive codebook 40, the stochastic codebook 43, the multipliers 41 and 44, and a second input terminal of the synthesis filter 47.

The demultiplexer 48 decomposes the voice discrimination data, the linear predictive coefficients, the delay L and the gain β of the adaptive codebook 40, and the index i and the gain γ of the stochastic codebook 43. The decomposed coefficients are outputted to the synthesis filter 47. The delay L is outputted to the adaptive codebook 40. The index i is outputted to the stochastic codebook 43. The gains β and γ are outputted to the multipliers 41 and 44, respectively.

When the adaptive code-vector is read from the adaptive codebook. 40, based on the delay L of the adaptive codebook 40 outputted from the multiplexer 48, the adaptive code-vector is selected. The adaptive code-vector read from the adaptive codebook 40 is multiplied at the multiplier 41 by the gain β received from the demultiplexer 48, then transmitted to the adder 42. The contents of the adaptive codebook 40 are the same as those of the adaptive codebook 20.

When the stochastic code-vector is read from the stochastic codebook 43, based on the index i of the stochastic codebook 43 outputted from the multiplexer 48, the stochastic code-vector is selected. The stochastic code-vector read from the stochastic codebook 43 is multiplied at the multiplier 44 by the gain γ received from the demultiplexer 48, then transmitted to the adder 42. The contents of the stochastic codebook 43 are the same as those of the stochastic codebook 23.

The adder 42 adds the amplified adaptive code-vector to the amplified stochastic code-vector, then transmits the added vector to the synthesis filter 47. The adder 42 also transmits the added vector to the adaptive codebook 40 through the delay circuit 46.

The synthesis filter 47 synthesizes the received linear predictive coefficients and the added vector, then transmits a synthesized vector to the output terminal 49. The output terminal 49 outputs the synthesized vector.

Figure 5:
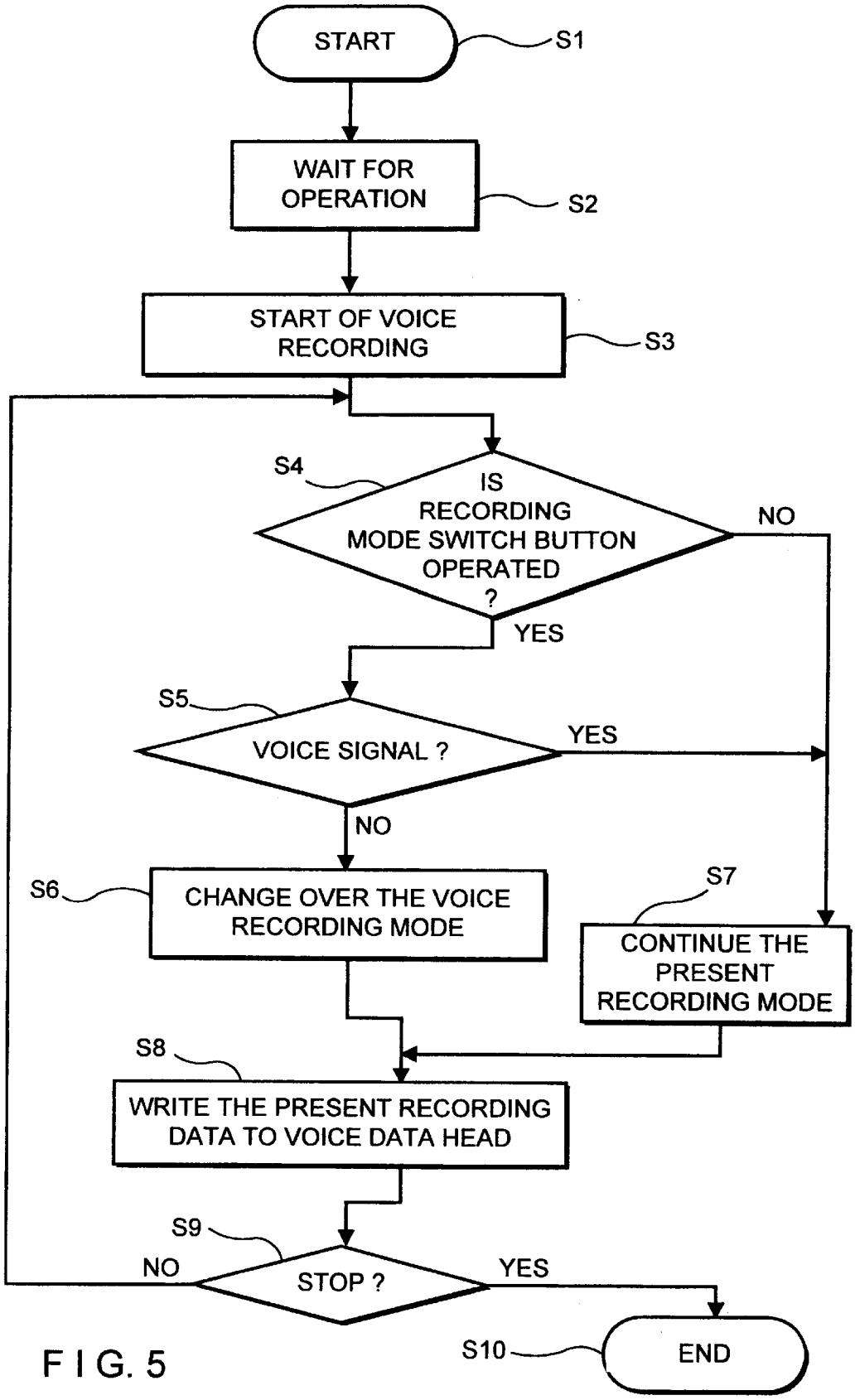
FIG. 5 is a flowchart which shows an operation of a system controller in the first embodiment of the present invention when a voice is recorded.

FIG. 5 is a flowchart which shows an operation of the system controller 17 in the first embodiment of the present invention as shown in FIG. 1 when a voice is recorded. The detailed operation process is described below.

In step S1, START corresponds to the state in which a power source has been turned on or a stop operation has been made at the mode operating portion 18.

In step S2, the system controller 17 is waiting until the next operation command is inputted.

In step S3, the voice recording begins depressing a recording button of the mode operating portion 18.

In step S4, it is judged whether the voice recording mode has been operated or not during the voice recording. If the judgment is positive, the process will be carried on to step S5. If the judgment is negative, the process will be carried on to step S7.

In step S5, the voice discriminating device 16 as shown in FIG. 1 judges whether the present frame includes the sampled digital voice signals or not. If the judgment is positive, the process will be carried on to step S7. If the judgment is negative, the process will be carried on to step S6.

In step S6, the voice recording mode is changed. That is, the coder/decoder a 14 is switched to the coder/decoder b 15, or reversely the coder/decoder b 15 to the coder/decoder a 14.

In step S7, the present voice recording mode is carried on.

In step S8, the recording mode selection data are added to a header of the coded data.

In step S9, it is judged whether the stop operation has been made or not. If positive, the process will be carried on to step 10. If negative, the process is returned to step S4.

In step 10, the voice recording operation is terminated.

Figure 6:
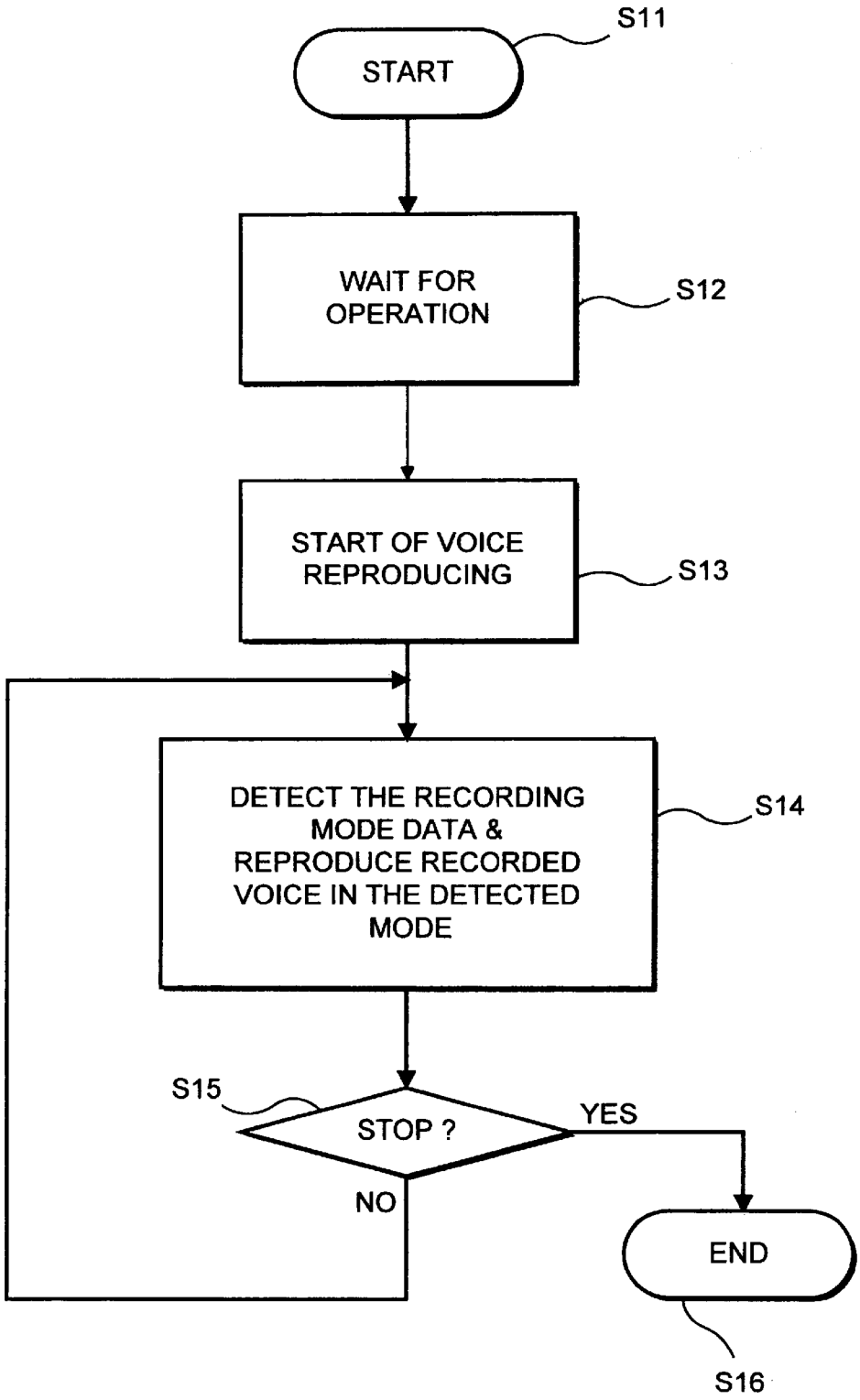
FIG. 6 is a flowchart which shows an operation of the system controller in the first embodiment of the present invention when a voice is reproduced.

FIG. 6 is a flowchart which shows an operation of the system controller 17 in the first and second embodiments of the present invention when a voice is reproduced.

In step S11, START corresponds to, for example, the state in which voice recording has been terminated.

In step S12, the system controller 17 is waiting until the next operation command is inputted.

In step S13, the recorded voice is reproduced by depressing a reproduction button in the mode operating portion 18.

In step S14, the recording mode selection data are detected, and, in accordance with the appropriate mode, the voice is reproduced based on the data.

In step S15, it is judged whether the stopping operation has been implemented or not during the voice reproduction in step S14. If the judgment is positive, the process will be carried on to step S16. If the judgment is negative, the process will be returned to step S14.

In step S16, the voice reproduction is terminated.

In the first embodiment, the present voice recording mode is continued until the input signal is judged not to be a voice signal, and when the inputted signal is judged not to be a voice, the present voice signal recording mode is changed over to the other voice recorder mode. Therefore, a strange sound due to the change over of the recording mode is reproduced in a low signal level. Hence, the reproduced voice is not substantially deteriorated so that the reproduced voice will be easy to listen.

Figure 7:
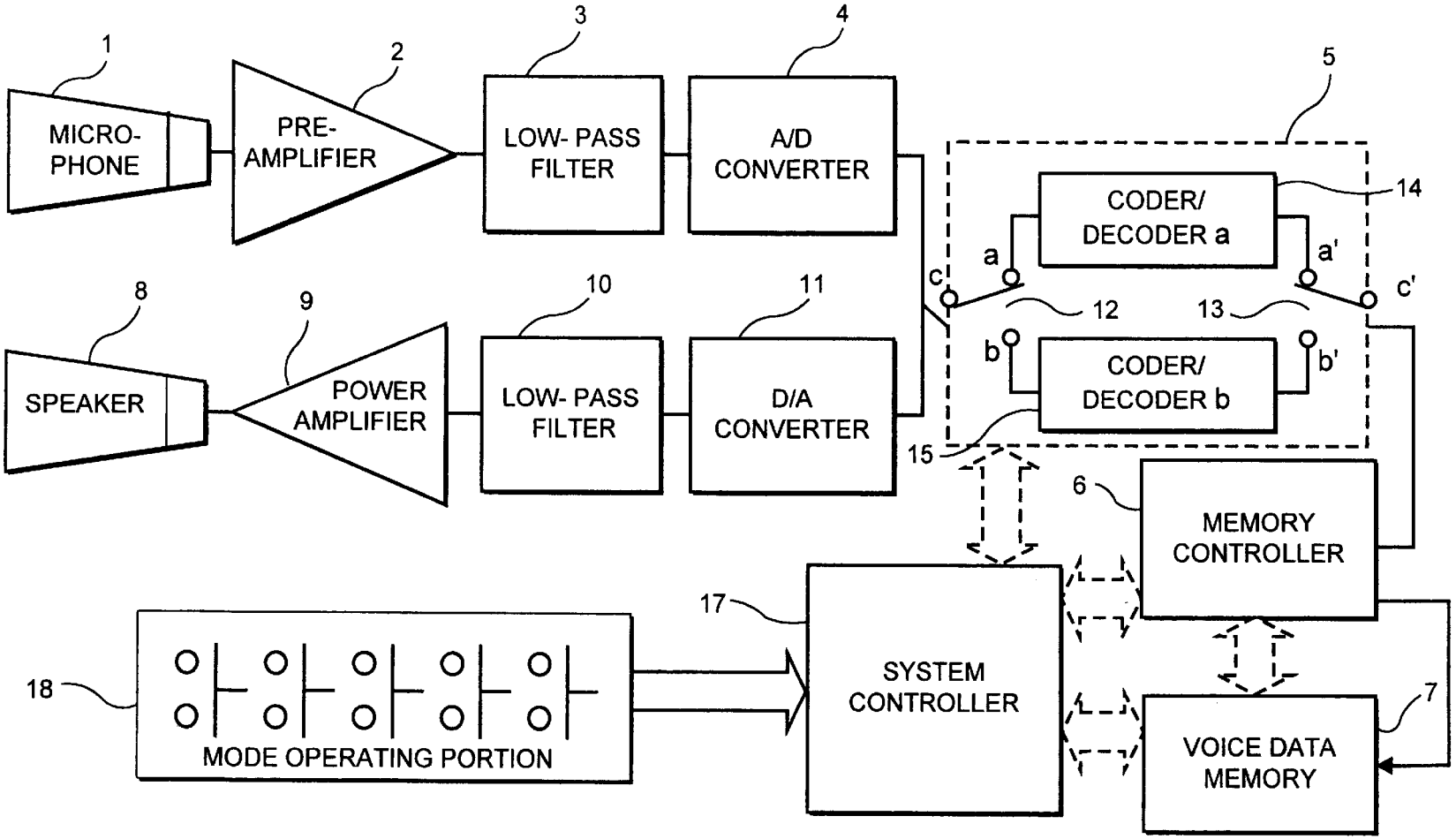
FIG. 7 is a block diagram which shows a structure of a digital voice recorder in a second embodiment of the present invention.

FIG. 7 is a block diagram which shows a structure of a digital voice recorder in a second embodiment of the present invention. FIG. 7 is the same as FIG. 1 except that FIG. 7 omits the voice discriminating device 16 of the first embodiment. The structures of the coders/decoders a (14) and b (15) of the coding/decoding portion 5 are the same as in FIGS. 2 and 4.

Figure 8:
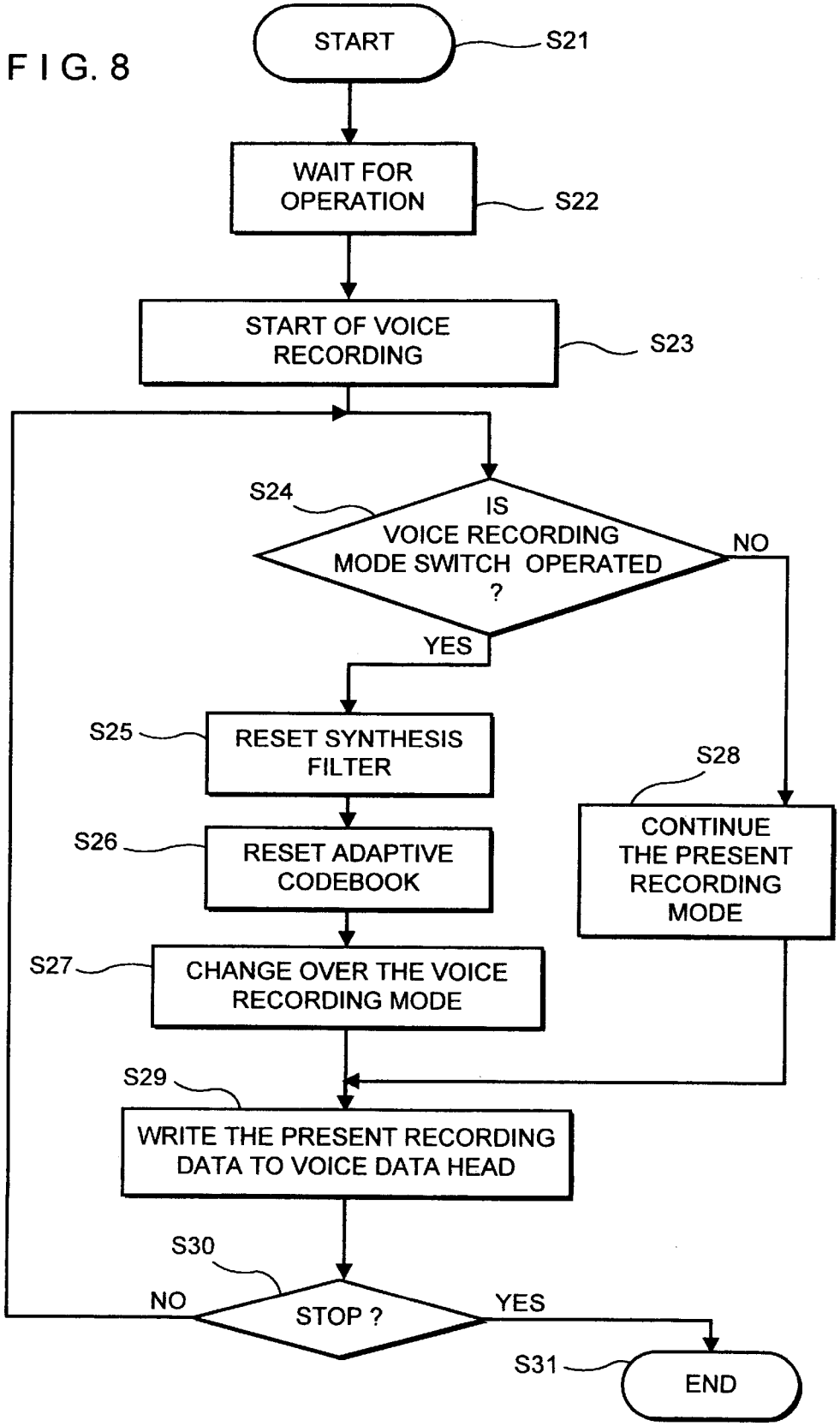
FIG. 8 is a flowchart which shows an operation of a system controller in the second embodiments of the present invention when a voice is recorded.

FIG. 8 is a flowchart which shows an operation of a system controller 17 in the second embodiment of the present invention as shown in FIG. 7, when a voice is recorded. The detailed operation process is described below.

In step S21, START corresponds to the state in which a power source has been turned on or stop operation has been made at the mode operating portion 18.

In step S22, the system controller 17 is waiting until the next operation command is inputted.

In step S23, the voice recording is started by depressing a recording button in the mode operating portion 18.

In step S24, it is judged whether the recording mode switching button has been operated or not during the voice recording. If the judgment is positive, the process will be carried on to step S25. If the judgment is negative, the process will be carried on to step S28.

In step S25, the contents of the synthesis filter 27 as shown in FIG. 2 are cleared.

In step S26, the contents of the adaptive codebook 20 are cleared.

In step S27, the present voice recording mode is changed over, meaning that the coder/decoder a 14 is changed over to the coder/decoder b 15, or the coder/decoder b 15 is changed over to the coder/decoder a 14.

In step S29, the present voice recording mode is carried on.

In step S29, the recording mode selection data are added to a header of the coded data.

In step S30, it is judged whether the stop operation has been made or not. If positive, the process will be carried on to step 31. If negative, the process is returned to step S24.

In step 31, the voice recording operation is terminated.

The meaning of resting of the contents of the synthesis filter 27 is described below.

Changing the coding bit rate by changing over the voice recording mode means that the value of n of the inputted signal X(n−p) is suddenly changed to a different value. Without providing a proper process, the voice is poorly reproduced because the initial condition of the contents of the synthesis filter 27 does not correspond to the inputted signals. Therefore, when the voice recording mode is changed over, the contents of the synthesis filter 27 must be reset, stored in the shift register or the like, and the values of the past input signals must be made zero as in the second embodiment.

The contents of the adaptive codebook 20 are also renewed based on the quantized data. Therefore, the adaptive codebook 20 will have the same problem as described above if the coding bit rate is changed. Hence, the contents of the adaptive codebook 20 must be reset just like the synthesis filter 27.

In the second embodiment, the voice is reproduced in the same way as the first embodiment (See FIG. 6). Thus, the description of its reproducing operation is omitted.

In the second embodiment, the contents of both the synthesis filter 27 and the adaptive codebook 20 are reset when the voice recording mode is changed over during voice recording so that the voice comfortable to listen to can be reproduced.

Although the CELP method is applied for voice coding in the embodiments of the present invention, another linear predictive coding method such as a multi-pulse coding method or the like may be used.

Further, the storage medium is not required when the voice data is transmitted from the transmitting side to the receiving side, where the transmitted data are immediately decoded.

I claim:

1. A voice recording device comprising:

a plurality of voice coding means having different bit rates for coding a voice to provide coded voice data;

selecting means for selecting one of the plurality of voice coding means and for providing a coding selection data;

recording means for recording the coding selection data and the coded voice data to a storage medium; and deterioration reducing means for, when another voice coding means is selected by the selecting means to change over the coding from the coding performed by a current voice coding means to the coding performed by the other selected voice coding means, performing a predetermined process for reducing a deterioration of the voice due to the change over of the coding by continuing an operation of the current voice coding means after the other voice coding means is selected until a predetermined feature is detected by the deterioration reducing means in the voice and without a delay being imposed on the coded voice data by the deterioration reducing means, wherein the deterioration reducing means permits the coding to change over to the other selected voice coding means when the predetermined feature is detected in the voice.

2. The device according to claim 1, wherein the deterioration reducing means includes a voice discriminating means for discriminating whether an input signal is a voice signal, and a control means for, when another voice coding means is selected by the selecting means, continuing the coding by the previously selected voice coding means until the input signal is discriminated to be a non-voice signal, and for changing over to the other voice coding means when the input signal is discriminated to be the non-voice signal.

3. The device according to claim 2, wherein at least one of the plurality of voice coding means includes a linear predictor for implementing a linear predictive coding on a frame-by-frame basis to code the voice on the basis of linear predictive coefficients and linear predictive residuals, and a synthesis filter for linear predictively synthesizing the voice to define quantized data which correspond to the linear predictive residuals for each frame, wherein the control means resets the contents of the synthesis filter when another voice coding means is selected by the selecting means.

4. The device according to claim 3, wherein at least one of the plurality of voice coding means includes an adaptive codebook updated by the quantized data, wherein the control means resets the contents of the adaptive codebook when another voice coding means is selected.

5. A voice recording and reproducing device comprising:

a plurality of voice coding means having different bit rates for coding a voice to provide coded voice data;

selecting means for selecting one of the plurality of voice coding means and for providing coding selection data;

recording means for recording the coding selection data and the coded voice data to a storage medium;

deterioration reducing means for, when another voice coding means is selected by the selecting means to change over the coding from the coding performed by a current voice coding means to the coding performed by the other selected voice coding means, performing a predetermined process for reducing a deterioration of the voice due to the change over of the coding by continuing an operation of the current voice coding means after the other voice coding means is selected until a predetermined feature is detected by the deterioration reducing means in the voice and without a delay being imposed on the coded voice data by the deterioration reducing means, wherein the deterioration reducing means permits the coding to change over to the other selected voice coding means when the predetermined feature is detected in the voice;

a plurality of voice decoding means having different bit rates for decoding the coded voice data, the bit rates of the plurality of voice decoding means corresponding to the bit rates of the plurality of voice coding means;

detecting means for detecting at the time of voice reproduction the coding selection data relating to the coding bit rate at which the voice was recorded; and reproduction mode selecting means for automatically selecting one of the plurality of voice decoding means which has the bit rate corresponding to the coding selection data detected by the detecting means.

6. The device according to claim 5, wherein the deterioration reducing means includes a voice discriminating means for discriminating whether an input signal is a voice signal, and a control means for, when another voice coding means is selected by the selecting means, continuing the coding by the previously selected voice coding means until the input signal is discriminated to be a non-voice signal, and for changing over to the other voice coding means when the input signal is discriminated to be the non-voice signal.

7. The device according to claim 6, wherein at least one of the plurality of voice coding means includes a linear predictor for implementing a linear predictive coding on a frame-by-frame basis to code the voice on the basis of linear predictive coefficients and linear predictive residuals, and a synthesis filter for linear predictively synthesizing the voice to define the quantized data which correspond to the linear predictive residuals for each frame, wherein the control means resets the contents of the synthesis filter when another voice coding means is selected by the selecting means.

8. The device according to claim 7, wherein at least one of the plurality of voice coding means includes an adaptive codebook updated by the quantized data, wherein the control means resets the contents of the adaptive codebook when another voice coding means is selected.

9. A voice data processor comprising:

a plurality of voice coding means having different bit: rates for coding a voice to provide coded voice data;

selecting means for selecting one of the plurality of voice coding means and for providing a coding selection data; and deterioration reducing means for, when another voice coding means is selected by the selecting means to change over the coding from the coding performed by a current voice coding means to the coding performed by the other selected voice coding means, performing a predetermined process for reducing a deterioration of the voice due to the change over of the coding by continuing an operation of the current voice coding means after the other voice coding means is selected until a predetermined feature is detected by the deterioration reducing means in the voice and without a delay being imposed on the coded voice data by the deterioration reducing means, wherein the deterioration reducing means permits the coding to change over to the other selected voice coding means when the predetermined feature is detected in the voice.

10. The device according to claim 9, wherein the deterioration reducing means includes a voice discriminating means for discriminating whether an input signal is a voice signal, and a control means for, when another voice coding means is selected by the selecting means, continuing the coding by the previously selected voice coding means until the input signal is discriminated to be a non-voice signal, and changing over to the other voice coding means when the input signal is discriminated to be the non-voice signal.

11. The device according to claim 10, wherein at least one of the plurality of voice coding means includes a linear predictor for implementing a linear predictive coding on a frame-by-frame basis to code the voice on the basis of linear predictive coefficients and linear predictive residuals, and a synthesis filter for linear predictively synthesizing the voice to define quantized data which correspond to the linear predictive residuals for the frame, wherein the control means resets the contents of the synthesis filter when another voice coding means is selected by the selecting means.

12. A voice recording device, comprising:

a controller;

at least one coding device in communication with the controller, the at least one coding device being capable of coding an input voice signal in accordance with a selected one of a plurality of bit rates in order to produce coded voice data;

a bit rate selection device in communication with the controller;

a voice data memory in communication with the controller; and a deterioration reducing device in communication with the controller and responsive to a selection of a switching operation from the selected one of the plurality of bit rates to another selected one of the plurality of bit rates in order to prevent a deterioration of the coded voice data due to the switch over from coding according to the selected one of the plurality of bit rates to coding according to the other selected one of the plurality of bit rates, the deterioration being prevented by the deterioration reducing device by continuing a coding according to the selected one of the plurality of bit rates after the other one of the plurality of bit rates is selected until a predetermined feature is detected by the deterioration reducing device in the input voice signal and without a delay being imposed on the coded voice data by the deterioration reducing device, wherein the deterioration reducing device permits the coding to switch over to the other selected one of the plurality of bit rates when the predetermined feature is detected in the input voice signal.

13. A voice recording and reproducing device, comprising:

a controller;

at least one coding device in communication with the controller, the at least one coding device being capable of coding a voice signal in accordance with a selected one of a plurality of bit rates in order to produce coded voice data;

a deterioration reducing device in communication with the controller and responsive to a selection of a switching operation from the selected one of the plurality of bit rates to another selected one of the plurality of bit rates in order to prevent a deterioration of the coded voice data due to the switch over from coding according to the selected one of the plurality of bit rates to coding according to the other selected one of the plurality of bit rates, the deterioration being prevented by the deterioration reducing device by continuing a coding according to the selected one of the plurality of bit rates after the other one of the plurality of bit rates is selected until a predetermined feature is detected by the deterioration reducing device in the voice signal and without a delay being imposed on the coded voice data by the deterioration reducing device, wherein the deterioration reducing device permits the coding to switch over to the other selected one of the plurality of bit rates when the predetermined feature is detected in the voice signal;

at least one decoding device in communication with the controller, the at least one decoding device being capable of decoding coded voice data in accordance with a selected one of a plurality of bit rates in order to reproduce a voice signal from the coded voice data;

a voice data memory in communication with the controller and including the coded voice data and associated coding selection data representing each bit rate according to which the voice signal was coded into the coded voice data; and a bit rate selection device in communication with the controller, the bit rate selection device selecting each bit rate of the plurality of bit rates corresponding to at least one of a user selection and the coding selection data.

14. A method of recording a voice signal in accordance with at least one of a plurality of bit rates, comprising:

selecting one of the plurality of bit rates;

producing coded voice data representative of the voice signal in accordance with the selected one of the plurality of bit rates;

determining whether the selected one of the plurality of bit rates is to be switched over to another one of the plurality of bit rates;

continuing producing, after the other one of the plurality of bit rates is selected, coded voice data in accordance with the selected one of the plurality of bit rates while the voice signal is detected in order to prevent a deterioration due to the switch over from coding according to the selected one of the plurality of bit rates to coding according to the selected other one of the plurality of bit rates, the step of continuing producing coded voice data being performed without a delay being imposed on the coded voice data during a performance of the deterioration prevention; and switching over to the other selected one of the plurality of bit rates when the voice signal is not detected.

15. The device according to claim 1, wherein a magnitude of each bit rate is independent of an energy contained in the voice.

16. The device according to claim 1, wherein the deterioration reducing means prevents a coding of the voice by the other selected voice coding means until a predetermined condition is met.

17. The device according to claim 16, wherein the predetermined condition is met when the voice changes from a first type of voice signal to a second type of voice signal.

* * * * *